US006659081B2

(12) United States Patent
Asano et al.

(10) Patent No.: US 6,659,081 B2
(45) Date of Patent: Dec. 9, 2003

(54) ARRANGEMENT FOR MOUNTING A SPARKPLUG OF AN INTERNAL COMBUSTION ENGINE

(75) Inventors: Morito Asano, Osaka (JP); Atsushi Ito, Osaka (JP); Nariki Maeda, Osaka (JP); Teruji Ichihara, Osaka (JP); Yoshiyuki Fukumura, Osaka (JP); Mitsuhiro Izumi, Osaka (JP)

(73) Assignees: Daihatsu Motor Co., Ltd., Osaka (JP); Diamond Electric Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/783,022

(22) Filed: Feb. 15, 2001

(65) Prior Publication Data

US 2001/0020464 A1 Sep. 13, 2001

(30) Foreign Application Priority Data

Mar. 7, 2000 (JP) ..... 2000-061442

(51) Int. Cl.[7] ..... F02P 13/00

(52) U.S. Cl. ..... 123/406.4; 123/406.41; 123/435; 123/169 EL; 73/35.08

(58) Field of Search ..... 123/406.4, 406.41, 123/169 EL, 435; 73/35.08

(56) References Cited

U.S. PATENT DOCUMENTS

| | | | | |
|---|---|---|---|---|
| 5,734,094 A | * | 3/1998 | Matsubara et al. | 73/35.08 |
| 5,907,243 A | * | 5/1999 | Goras et al. | 123/435 |
| 6,032,650 A | * | 3/2000 | Rask | 123/435 |
| 6,205,774 B1 | * | 3/2001 | Hohner et al. | 73/35.08 |

FOREIGN PATENT DOCUMENTS

| | | |
|---|---|---|
| JP | 02-99261 U | 8/1990 |
| JP | 04-112944 A | 4/1992 |
| JP | 5-118266 | 5/1993 |
| JP | 09-317618 | 12/1997 |
| JP | 2000-161193 A | 6/2000 |

* cited by examiner

*Primary Examiner*—Erick Solis
(74) *Attorney, Agent, or Firm*—Banner & Witcoff, Ltd.

(57) ABSTRACT

The arrangement for mounting a sparkplug of an internal combustion engine includes mounting the sparkplug so that all of the outside electrodes are arranged at an intake port side area and/or an exhaust port side area. Alternatively, in the case where at least one of the outside electrodes is located outside of the above-mentioned areas, no other remaining outside electrodes are arranged at a position that faces that outside electrode across the central electrode.

20 Claims, 5 Drawing Sheets

ARRANGEMENT FOR MOUNTING A SPARKPLUG OF AN INTERNAL COMBUSTION ENGINE

BACKGROUND OF THE INVENTION

This invention relates to an arrangement for mounting a sparkplug of an internal combustion engine, wherein the sparkplug is used for detecting an ionic current flowing in a combustion chamber to detect an occurrence of knock or the like.

RELATED ART STATEMENT

Conventionally, in an internal combustion engine for an automobile, the occurrence of knock or a limit of lean burn driving is judged by making use of an ionic current flowing in a combustion chamber immediately after ignition. The ionic current is detected by applying high voltage between a central electrode and an outside electrode of a sparkplug and detecting a current due to an electrical discharge with the central electrode and the outside electrode. In this case, in order to obtain the ionic current, positive voltage is applied to the central electrode of the sparkplug and negative voltage is applied to the outside electrode of the sparkplug. This arrangement is used to detect a subtle ionic current accurately by charging the outside electrode with negative electricity so as to charge the whole inner wall in the combustion chamber with negative electricity, which substantially increases an area of the electrode, which attracts a large amount of ions charged with positive electricity.

As a sparkplug for detecting an ionic current it is known, for example, that a surface area of a central electrode may be made wider, as mentioned in Japanese Laid Open Patent Publication No. 5-118266 or that a central electrode and an outside electrode arranged around the central electrode may be made longer than ordinary, as mentioned in Japanese Laid Open Patent Publication No. 9-317618, in order to improve an ionic current detection accuracy.

In the case where a central electrode and an outside electrode of a sparkplug are used as electrodes for detecting an ionic current, each of the electrodes suffers from abrasion due to electrical discharge of high voltage. In such situations, it is preferable to use a multi-pole sparkplug having a plurality of outside electrodes in order to improve resistance to abrasion. However, for a two-pole sparkplug having two outside electrodes each facing across a central electrode as the center, the accuracy of detecting an occurrence of knock may be lowered depending on a mounting direction of the outside electrodes on the cylinder head.

Generally, when driving after warming-up, the temperature of the inner wall of the combustion chamber near the exhaust valve becomes high. When mixed air touches the inner wall of the combustion chamber at high temperature, the mixed air may be ignited by itself due to the high temperature of the inner wall, resulting in an occurrence of knock. When drawing in and compressing air into the cylinder, the mixed air from the intake port passes near the exhaust port, which is arranged to face the intake port, and then passes an upper part of the piston and finally returns to the intake port again so as to circulate in the cylinder. More specifically, the mixed air is introduced from the intake port along a ceiling of the combustion chamber, flows along an inner face of the cylinder facing the intake port, and then flows along an upper part of the piston and the inner face of the cylinder so as to circulate in a cylinder. Due to the flow of the mixed air, the mixed air at the side of the intake valve burns later than the other portion that is ignited, and pressure at the intake valve side also rises. Then the temperature of the mixed air rises while combustion is retarded, which makes the portion of the mixed air where combustion was retarded ignite by itself, resulting in an occurrence of knock. As mentioned above, when knock occurs, a pressure wave is generated in the combustion chamber. If a plurality of outside electrodes and the central electrode fall on a line in a direction at generally a right angle with the pressure wave generated when knock occurs, the outside electrodes disturb diffusion of the ionic current, which may disturb detecting the ionic current.

OBJECT AND SUMMARY OF THE INVENTION

An object of this invention is to solve the above problems. In order to attain the object, this invention takes the following measures. In an arrangement for mounting a sparkplug of an internal combustion engine, a sparkplug having a plurality of outside electrodes arranged to surround a central electrode is mounted so that the outside electrodes are arranged at positions to avoid a position generally at a right angle with respect to a direction in which a pressure wave travels. Alternatively, in the case where one of the outside electrodes is arranged at a position generally at a right angle with respect to a direction in which a pressure wave travels, the other remaining outside electrodes are arranged at positions to avoid facing each other across the central electrode.

This invention is an arrangement for mounting a sparkplug of an internal combustion engine wherein the arrangement detects an ionic current which flows after ignition in a combustion chamber of an internal combustion engine. An intake port and an exhaust port open into the combustion chamber. The ionic current is measured by the use of a sparkplug comprising a central electrode and a plurality of outside electrodes arranged spaced apart to surround the central electrode. The sparkplug is mounted so that all of the outside electrodes are arranged in areas at an intake port opening side of the cylinder (defined between the sparkplug and the intake port opening) and/or at an exhaust port opening side of the cylinder (defined between the sparkplug and the exhaust port opening). Alternatively, in the case where at least one of the outside electrodes is located outside of the above-mentioned areas, the other remaining outside electrodes are arranged at positions to avoid facing the outside electrode located outside of the areas described above across the central electrode.

In accordance with the arrangement, the outside electrodes are not arranged facing each other across the central electrode in a direction at generally a right angle with respect to the pressure wave generated when knock occurs. In other words, knock occurs when abnormal combustion occurs due to self-ignition in the intake port and the exhaust port. The pressure wave generated by the abnormal combustion travels or diffuses from the intake port opening to the exhaust port opening or from the exhaust port opening to the intake port opening. In the case where the outside electrode and the central electrode are arranged in a limited area existing in a direction the pressure wave travels or where they are arranged outside of the limited are abut other remaining outside electrodes are not located at a position facing the outside electrode across the central electrode, influence of the pressure wave on the ionic current is suppressed to a minimum. As a result, the ionic current can be detected with ease and the accuracy of the ionic current detected can be improved, thereby improving the accuracy of detecting an occurrence of knock.

For a sparkplug having a plurality of outside electrodes, it is preferable if all of the outside electrodes are arranged at positions not facing each other across the central electrode. For example, this may be accomplished by providing three outside electrodes arranged each spaced apart at an angle of 120 degrees around the central electrode as the center. In accordance with the arrangement of the outside electrodes according to the invention, in the case where at least one of the outside electrode is arranged at the position to be avoided, there is no other outside electrode at a position facing this outside electrode across the central electrode, which makes it possible to position the outside electrodes with ease when mounting the sparkplug.

DETAILED DESCRIPTION OF THE PREFERRED EMBODIMENTS

Embodiments of the invention will be described in detail with reference to the drawings.

Figure 1:
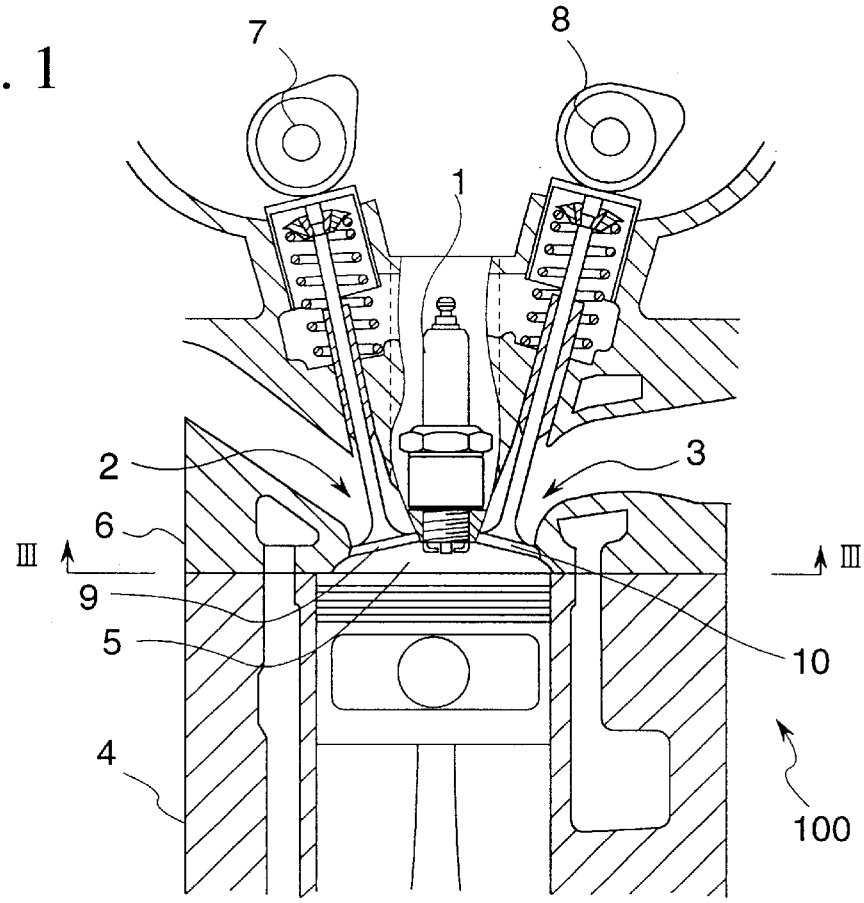
FIG. 1 is a cross-sectional view showing a principal portion of an embodiment of the present claimed invention.
Figure 3:
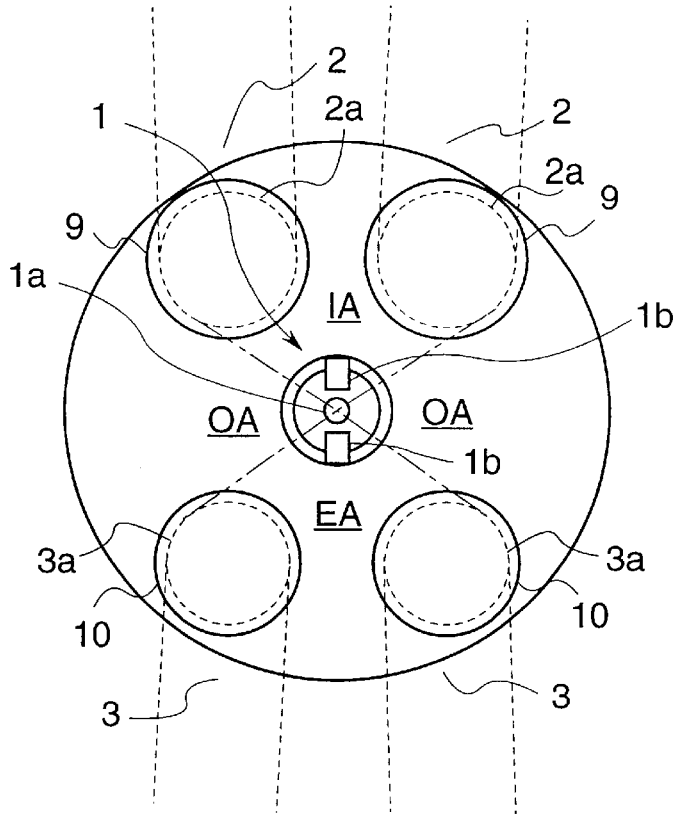
FIG. 3 is a view taken along line III—III in FIG. 1.

FIG. 1 illustrates a sectional view of an internal combustion engine 100 including a portion where a sparkplug 1 is mounted. An opening of an intake port 2 and an opening of an exhaust port 3 are arranged to face each other across the sparkplug 1, which is mounted at a general center of a ceiling of a combustion chamber 5. The intake port opening 2*a* and exhaust port opening 3*a* are arranged at two portions respectively per a cylinder, as shown in FIG. 3. The engine is mounted on a cylinder block 4, and camshafts 7 and 8 are respectively mounted on an intake port side and an exhaust port side of a cylinder head 6 forming the ceiling of the combustion chamber 5. The intake port 2 of the cylinder head 6 is made to open or close by means of an intake valve 9, which makes a reciprocating motion due to rotation of the camshaft 7. The exhaust port 3 is made to open or close by means of an exhaust valve 10, which opens and closes due to rotation of camshaft 8. Between the intake port 2 and the exhaust port 3, the sparkplug 1 is mounted, which also serves to detect an ionic current.

Figure 2:
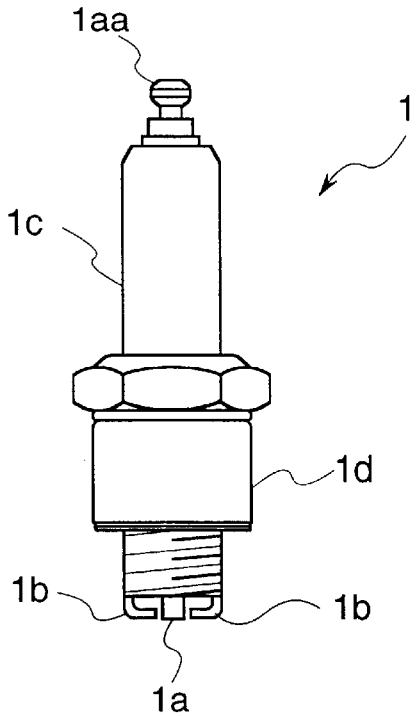
FIG. 2 is a front view of a sparkplug in accordance with the embodiment.

The sparkplug 1 of this embodiment is, as shown in FIG. 2, a double-pole sparkplug comprising a central electrode 1*a* and a plurality of outside electrodes 1*b*. In this example, the sparkplug 1 is arranged so that the central electrode 1*a* passes through a center of the cylinder-shaped insulator 1*c*, and a shell 1*d* made of metal fits over a lower half portion of the insulator 1*c* through a gasket which is not shown in drawings. Two outside electrodes 1*b* are integrally arranged at positions facing each other across the center electrode 1*a* on a bottom face of the shell 1*d*. A top end of the center electrode 1*a* projects out of a top end of the insulator 1*c*, and a terminal nut 1*aa* is provided at the top end of the center electrode 1*a* so a high-voltage cable (which is not shown in drawings) can be connected. A bottom end of the center electrode 1*a* projects by a predetermined length out of a bottom end of a mounting external thread locating at a bottom end of the shell 1*d*. Each of the outside electrodes 1*b* is in a shape of an L character in side view, wherein a side end face of a level portion of the outside electrode 1*b* faces toward a circumferential face at the bottom end of the central electrode 1*a*, and a bottom face of the level portion is set to have generally the same height as that of the bottom end of the central electrode 1*a*.

In accordance with the arrangement of the sparkplug 1, for detecting an ionic current which flows in the combustion chamber 5 of the engine after ignition, as shown in FIG. 3, the sparkplug 1 is mounted so that all of the outside electrodes 1*b* are arranged at the intake port 2 side area and/or at the exhaust port 3 side area. The intake port side is defined by the area limited by the sparkplug 1 and the intake port openings 2*a*, and the exhaust port side area is defined by the area limited by the sparkplug 1 and the exhaust port openings 3*a*. In the case where at least one of the outside electrodes 1*b* is located outside of the above-mentioned limited areas, the other remaining outside electrodes 1*b* are arranged at positions to avoid facing that outside electrode 1*b* across the central electrode 1*a*. The intake port side area is defined by the sparkplug 1 and the intake port openings 2*a*, and it means the area surrounded by two segments (shown by imaginary lines in FIG. 3) between the center of the sparkplug 1 and the most separated surrounding lines near the openings 2*a* of the two intake ports 2 and designated as intake port area IA in FIG. 3. Likewise, the exhaust port side area is defined by the sparkplug 1 and the exhaust port openings 3*a*, and it means the area surrounded by two segments (shown by imaginary lines in FIG. 3) between the center of the sparkplug 1 and the most separated surrounding lines near the openings 3*a* of the two exhaust ports 3 and designated as exhaust port area EA in FIG. 3.

A relationship between a position of the outside electrodes 1*b* and the intake port area IA and the exhaust port area EA will now be explained with reference to FIG. 3. FIG. 3 is a schematically shown view of the ceiling portion of the combustion chamber 5 taken along line III—III in FIG. 1. In FIG. 3, the sparkplug 1 is mounted so that the outside electrodes 1*b* are located in the intake port area IA and the exhaust port area EA. As a result, in this double-pole sparkplug 1 having two outside electrodes 1*b*, all of the outside electrodes 1*b* are located in the intake port area IA or the exhaust port area EA, and particularly, there is no outside electrode existing in areas OA of FIG. 2, which are located between the intake port area IA and the exhaust port area EA. In mounting the sparkplug 1, tighten the sparkplug 1 using a box wrench with a direction of the box wrench coinciding with the direction of the outside electrodes 1*b*. This makes it possible to arrange the outside electrodes 1*b* at a desired position just by watching the direction of the box wrench without visually checking the direction of the outside electrodes 1*b*.

High voltage is applied to this sparkplug 1 with the central electrode 1*a* as the positive electrode and the outside electrodes 1*b* as the negative electrodes, in order to detect an ionic current flowing in the combustion chamber 5 after ignition. An electrical discharge occurs between the central electrode 1*a* and the outside electrodes 1*b* when the high voltage is applied. The electrical discharge makes an ionic current flow through $H_3O^+$ ions contained in the combustion gas. The ionic current is detected by the central electrode 1*a* and the outside electrodes 1*b* including a cylinder inner wall. When knock occurs while detecting the ionic current, a pressure wave generated by the knock travels or diffuses from the intake port 2 side to the exhaust port 3 side or from the exhaust port 3 side to the intake port 2 side. Detection efficiency changes depending on a position of the outside electrode 1*b* relative to a diffusing condition of the ion because it is affected by the pressure wave. In the case where the outside electrodes 1*b* are located in the intake port area IA and the exhaust port area EA, the direction to which the pressure wave diffuses generally coincides with a direction in which the ionic current flows, and therefore a knock component, which is added to the ionic current, is conspicuously shown.

Figure 4:
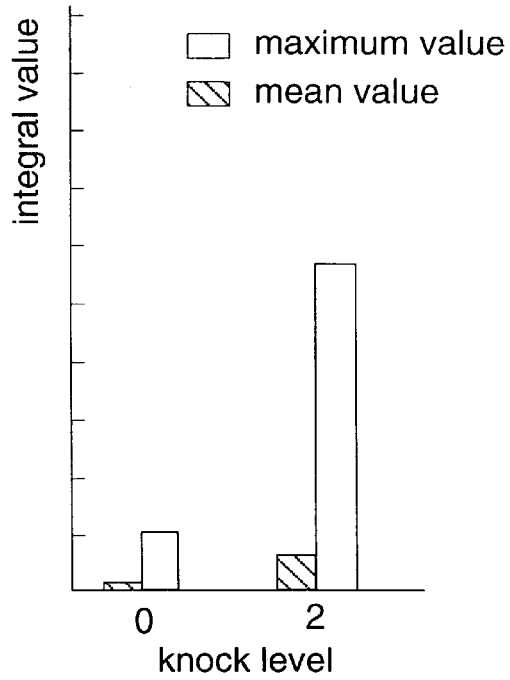
FIG. 4 is a bar graph showing a result of detecting an ionic current in accordance with the embodiment.

The bar graph shown in FIG. 4 is a result of detecting the ionic current in two cases while the engine is driven at middle speed. One of the cases is where the knock level is 0, which means no knock occurs and the other case is where a knock level is 2, which means knock occurs. The bar graph shown in FIG. 5 is a result for comparison in which the outside electrodes 1*b* are arranged outside of the intake port area IA and the exhaust port area EA, namely, in the specified areas OA between the intake port area IA and the exhaust port area EA, as shown in FIG. 6.

To detect the knock component, ignition timing is advanced in angle until knock occurs having a desired knock level, and high voltage is applied between the center electrode 1*a* and the outside electrodes 1*b* after ignition so that an ionic current flows when knock occur. This ionic current is detected, and a knock component (current having a knock frequency), which is added to the detected ionic current, also is detected. The knock level 0 means a detected current (due to noise) which is added to the ionic current and which is approximate to a knock component when no knock occurs. Generally, the higher the detected value (value of wave length) of the ionic current becomes, the bigger the knock component becomes. The ionic current is detected several times, for example, 100 times, and the knock component which is added to the detected ionic current is integrated and a mean value and the maximum value are shown in the bar graph. The above-explained result is a case in which the engine was driven at middle speed, however, generally the same results were obtained in both cases at low and high speed.

Figure 5:
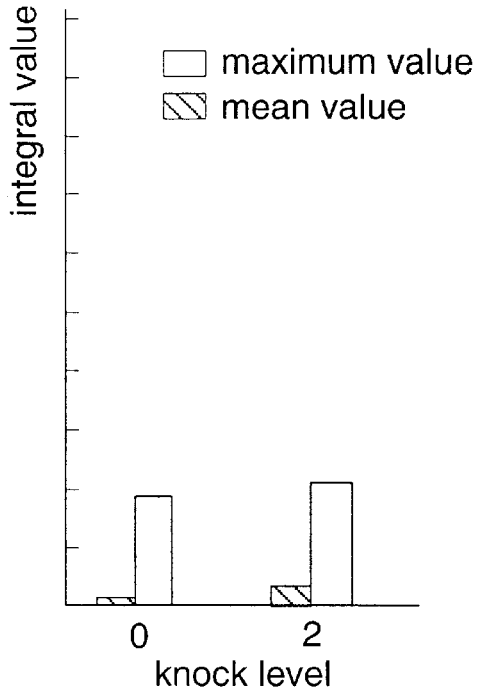
FIG. 5 is a bar graph showing a result of detecting an ionic current of an example for comparison to the result of the embodiment.
Figure 6:
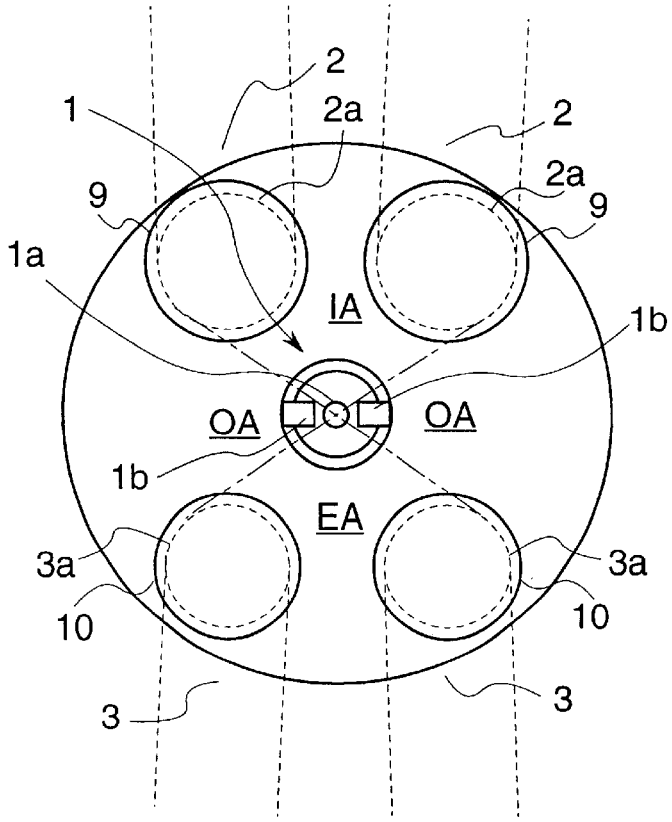
FIG. 6 is a view of the example for comparison with FIG. 3.

As is clear in the graphs of FIGS. 4 and 5, the embodiment wherein the outside electrodes 1*b* are arranged in the intake port area IA and the exhaust port area EA (FIGS. 3 and 4) shows a maximum value that is approximately three times as much as that of the comparison example (FIGS. 5 and 6) and a mean value that is approximately twice as much as that of the comparison example. In addition, since in the embodiment of FIGS. 3 and 4 the result of the knock level 2 is approximately four times as much as that of the knock level 0 in the mean value and approximately five times in the maximum value, it is possible to detect an occurrence of knock with ease, thereby improving the accuracy of knock detection.

The invention is not limited to the above-described embodiment.

Figure 7:
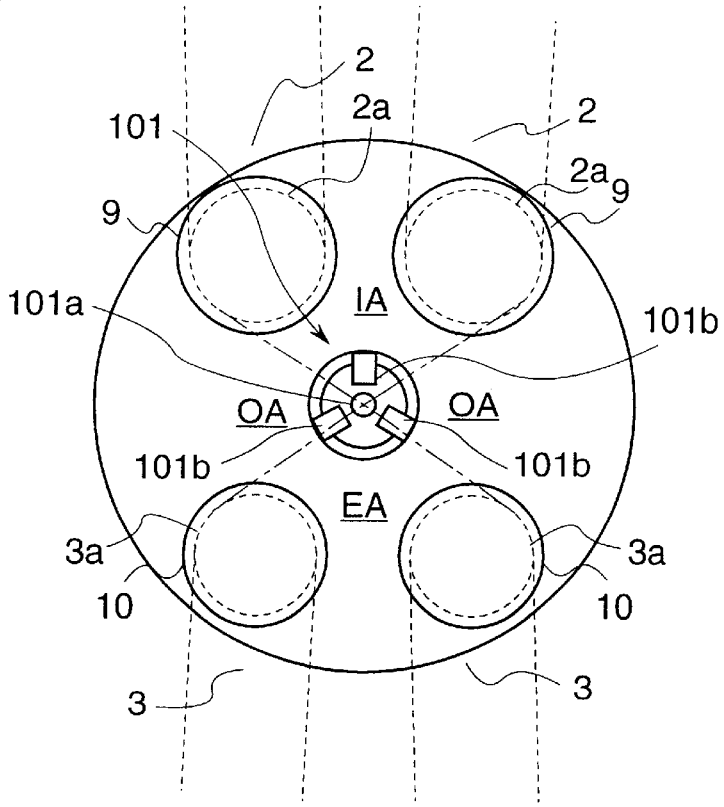
FIG. 7 is a view of another embodiment in accordance with the present claimed invention.

For example, the number of the outside electrodes on the sparkplug may be three, four or five. In the case where a sparkplug 101 has three outside electrodes 101*b*, as shown in FIG. 7, the outside electrodes 101*b* may be arranged each spaced apart at an angle of 120 degrees around the central electrode 101*a*. For this three-pole sparkplug 101, one of the outside electrodes 101*b* is arranged, for example, in the intake port area IA and the remaining two outside electrodes 101*b* are arranged extending over the specified area OA. In this case, however, since the two outside electrodes 101*b* are arranged extending over the specified area OA separated at an angle of 120 degrees around the center, there is no chance that the outside electrodes 101*b* will face each other across the central electrode 101*a*. As a result, no outside electrode 101*b* is arranged at a position which is affected by a pressure wave when knock occurs. This makes it possible to detect the ionic current with ease, thereby improving the accuracy of detecting knock.

Figure 8:
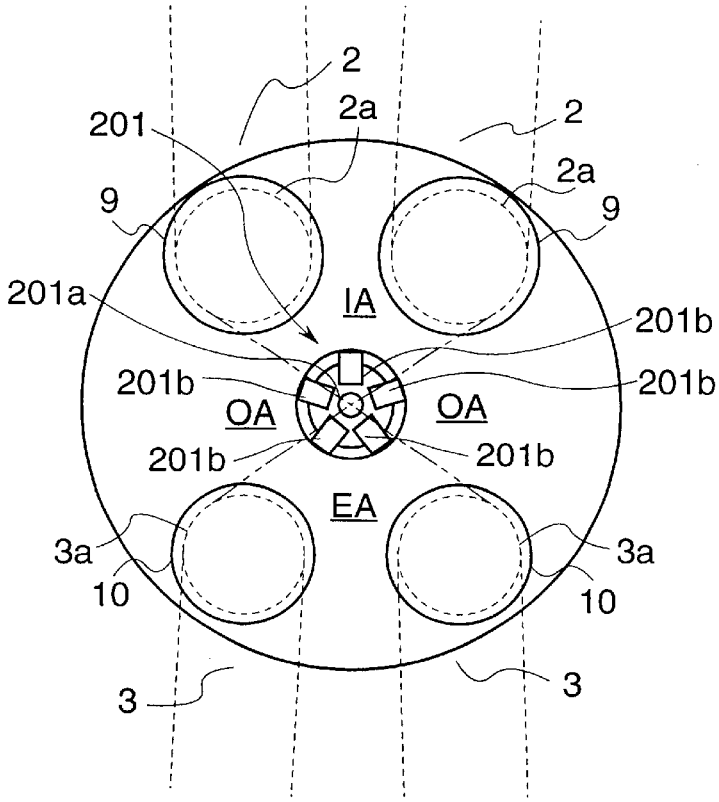
FIG. 8 is a view of a third embodiment in accordance with the present claimed invention.
Figure 9:
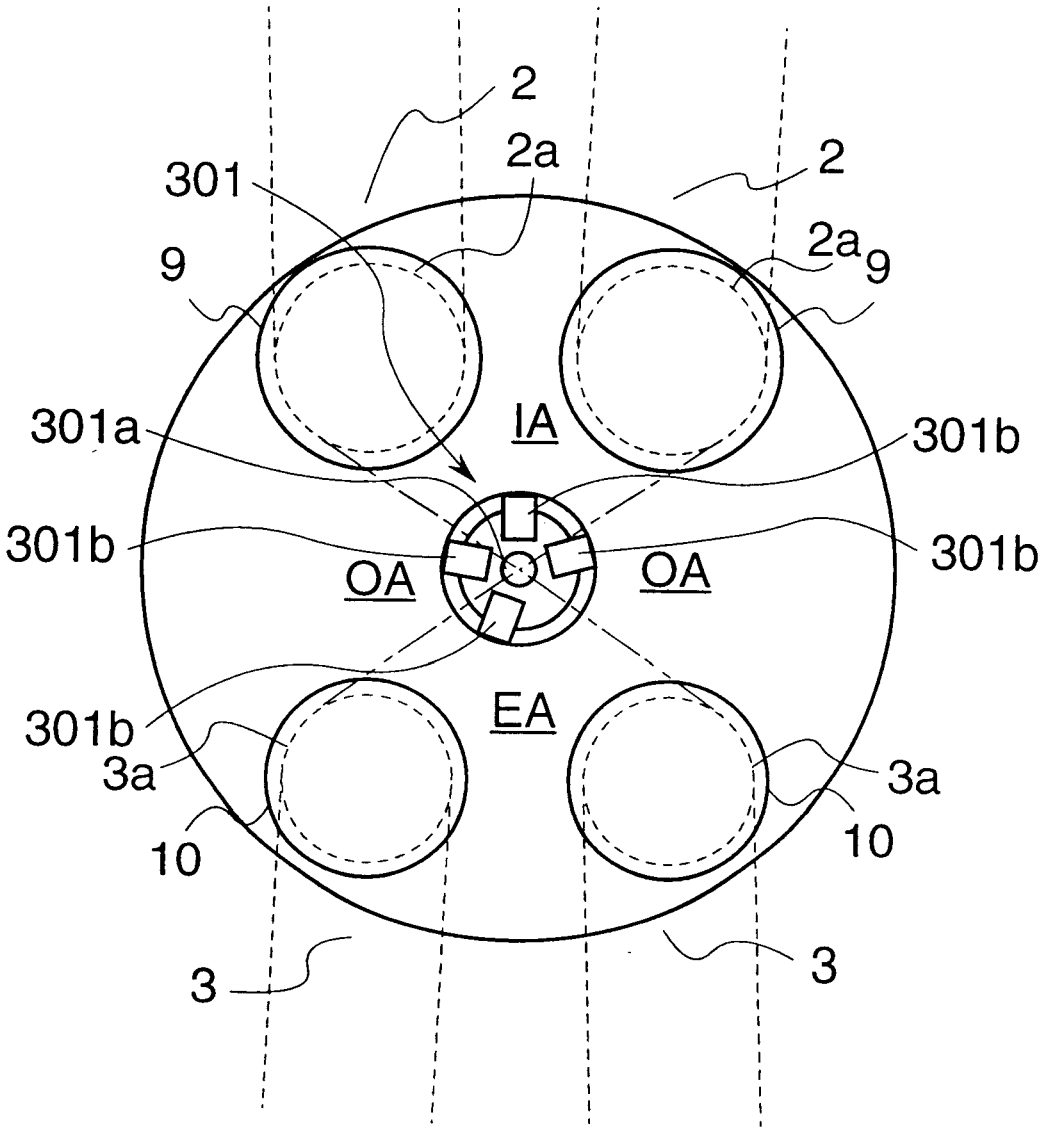
FIG. 9 is a view of a fourth embodiment in accordance with the present claimed invention.

For a five-pole sparkplug arrangement 210 as shown in FIG. 8, five outside electrodes 201*b* may be arranged each spaced apart at an angle of 72 degrees around a central electrode 201*a*. For a sparkplug 301 having four outside electrodes 301*b*, as shown in FIG. 9, the outside electrodes 301*b* may be arranged spaced apart, not at equal intervals at right angles around a central electrode 301*a*, but at non-equal intervals so that no outside electrode 301*b* is arranged at a position that faces an outside electrode 301*b* located outside of the intake port area IA and the exhaust port area EA, across the central electrode 301*a*. In accordance with the outside electrodes 301*b* arranged spaced apart at non-equal intervals, when one of the outside electrodes 301*b* is located in the specified area OA between the intake port area IA and the exhaust port area EA, it can be avoided that another outside electrode 301*b* is located at a position facing the outside electrode 301*b* located in the specified area OA across the central electrode 301*a*. As a result, this arrangement of the outside electrodes 301*b* does not deteriorate the ionic current detection accuracy like the example for comparison.

For a sparkplug having two outside electrodes, the outside electrodes may be arranged to face each other across a central electrode unlike the above-explained arrangement. For a three-pole or five-pole sparkplug, the outside electrodes may be arranged such that they are not each spaced apart at equal angles, but may be arranged at a variety of different angles around a central electrode. As mentioned above, the sparkplug may be arranged otherwise as long as the outside electrodes are not arranged to face each other across the central electrode, in other words, the sparkplug may be arranged in any form as long as the outside electrodes are not arranged spaced apart at an angle of 180 degrees. In accordance with the arrangement of the sparkplug, it becomes possible to position the outside electrodes with ease in mounting the sparkplug.

In the above-explained embodiment two intake ports and two exhaust ports are arranged to open respectively, but the number of intake port openings and exhaust port openings is not limited to two, and each of the numbers may be one. In addition, one exhaust port opening may be arranged with two intake port openings.

The arrangement of the other components also is not limited to the drawings of the above-mentioned embodiment, and there may be various modifications without departing from the spirit and essential characteristics thereof.

As mentioned above, in accordance with the invention, since the sparkplug is mounted so that all of the outside electrodes are arranged in the intake port side area and/or the exhaust port side area, or in the case where at least one of the outside electrodes is located outside of the above-mentioned limited areas, the other remaining outside electrodes are arranged at positions to avoid facing the outside electrode located outside of the above-mentioned limited area across the central electrode, there is no chance of any outside electrodes facing each other across the central electrode in a direction at generally a right angle with respect to a pressure wave generated when knock occurs, to thereby suppress an effect of the pressure wave on the ionic current to a minimum when the ionic current flows. As a result, ions diffuse effectively, which makes it possible to detect the ionic current with ease, to thereby detect an occurrence of knock precisely based on the knock component added to the ionic current.

As a sparkplug having a plurality of outside electrodes, if all of the outside electrodes are arranged across a central electrode at positions where any of the outside electrodes do not face each other, no outside electrode is arranged at a position facing another outside electrode across the central electrode even, though at least one of the outside electrodes is arranged in a position between the intake and exhaust opening side areas. As a result, it becomes possible to position the outside electrodes with ease.

What is claimed is:

1. An arrangement for mounting a sparkplug of an internal combustion engine, comprising:

a cylinder head defining a portion of a combustion chamber of the internal combustion engine, wherein the cylinder head defines at least one intake port opening and at least one exhaust port opening; and a sparkplug mounted on the cylinder head, the sparkplug including a central electrode and a plurality of outside electrodes spaced apart and arranged around the central electrode, wherein the sparkplug detects an ionic current that flows after ignition in the combustion chamber, and wherein the sparkplug is mounted on the cylinder head such that all of the outside electrodes are arranged at an intake port side area or an exhaust port side area of the combustion chamber, wherein the intake port side area is defined as an area between a first line extending from a center of the sparkplug to a first outside edge of the at least one intake port opening and a second line extending from the center of the sparkplug to a second outside edge of the at least one intake port opening, wherein the first line and the second line are located a maximum distance from one another, and wherein the exhaust port side area is defined as an area between a third line extending from the center of the sparkplug to a first outside edge of the at least one exhaust port opening and a fourth line extending from the center of the sparkplug to a second outside edge of the at least one exhaust port opening, wherein the third line and the fourth line are located a maximum distance from one another.

2. The arrangement according to claim 1, wherein the outside electrodes of the sparkplug do not face each other across the central electrode.

3. The arrangement according to claim 1, wherein the sparkplug has three outside electrodes each spaced apart at an angle of 120 degrees around the central electrode.

4. The arrangement according to claim 1, wherein the cylinder head defines two intake port openings.

5. The arrangement according to claim 1, wherein the cylinder head defines two exhaust port openings.

6. The arrangement according to claim 1, wherein the outside electrodes of the sparkplug are unevenly spaced around the central electrode.

7. The arrangement according to claim 1, wherein the sparkplug has two outside electrodes.

8. The arrangement according to claim 1, wherein the sparkplug has three outside electrodes.

9. The arrangement according to claim 1, wherein the sparkplug has four outside electrodes.

10. The arrangement according to claim 1, wherein the sparkplug has five outside electrodes.

11. An arrangement for mounting a sparkplug of an internal combustion engine, comprising:

a cylinder head defining a portion of a combustion chamber of the internal combustion engine, wherein the cylinder head defines at least one intake port opening and at least one exhaust port opening; and a sparkplug mounted on the cylinder head, the sparkplug including a central electrode and a plurality of outside electrodes spaced apart and arranged around the central electrode, wherein the sparkplug detects an ionic current that flows after ignition in the combustion chamber, and wherein the sparkplug is mounted on the cylinder head such that at least one outside electrode is located outside of an intake port side area and an exhaust port side area and all remaining outside electrodes are arranged at positions that do not face said at least one outside electrode that is located outside of the intake port side area and the exhaust port side area across the central electrode, wherein the intake port side area is defined as an area between a first line extending from a center of the sparkplug to a first outside edge of the at least one intake port opening and a second line extending from the center of the sparkplug to a second outside edge of the at least one intake port opening, wherein the first line and the second line are located a maximum distance from one another, and wherein the exhaust port side area is defined as an area between a third line extending from the center of the sparkplug to a first outside edge of the at least one exhaust port opening and a fourth line extending from the center of the sparkplug to a second outside edge of the at least one exhaust port opening, wherein the third line and the fourth line are located a maximum distance from one another.

12. The arrangement according to claim 11, wherein the outside electrodes of the sparkplug do not face each other across the central electrode.

13. The arrangement according to claim 11, wherein the sparkplug has three outside electrodes each spaced apart at an angle of 120 degrees around the central electrode.

14. The arrangement according to claim 11, wherein the cylinder head defines two intake port openings.

15. The arrangement according to claim 11, wherein the cylinder head defines two exhaust port openings.

16. The arrangement according to claim 11, wherein the outside electrodes of the sparkplug are unevenly spaced around the central electrode.

17. The arrangement according to claim 11, wherein the sparkplug has two outside electrodes.

18. The arrangement according to claim 11, wherein the sparkplug has three outside electrodes.

19. The arrangement according to claim 11, wherein the sparkplug has four outside electrodes.

20. The arrangement according to claim 11, wherein the sparkplug has five outside electrodes.

* * * * *